US005769261A

United States Patent [19]

Gaffney et al.

[11] Patent Number: 5,769,261

[45] Date of Patent: Jun. 23, 1998

[54] FOOD SERVING PAN WITH REMOVABLE COVER

[75] Inventors: Thomas E. Gaffney, Sheboygan; Alan J. Schommer, Fredonia; William C. Heimerl, Hingham; Michael L. Carpenter, Sheboygan, all of Wis.

[73] Assignee: The Vollrath Company, L.L.C., Sheboygan, Wis.

[21] Appl. No.: 648,509

[22] Filed: May 15, 1996

[51] Int. Cl.[6] ..... B65D 43/24

[52] U.S. Cl. ..... 220/335; 220/337; 220/212.5; 220/528

[58] Field of Search ..... 220/4.22, 23.86, 220/331, 335, 337, 340, 212.5, 528, 574, 912; 215/235

[56] References Cited

U.S. PATENT DOCUMENTS

| | | | |
|---|---|---|---|
| 1,019,198 | 3/1912 | Spears | 220/335 |
| 1,068,274 | 7/1913 | Reynolds | 220/335 |
| 1,158,520 | 11/1915 | McConachy | 220/337 |
| 1,171,601 | 2/1916 | Eichenberg | 220/337 |
| 1,396,876 | 11/1921 | Platt | 220/337 |
| 1,557,454 | 10/1925 | Hammer | 220/337 |
| 1,873,534 | 8/1932 | Brethen | 220/337 X |
| 2,086,534 | 7/1937 | Byrne | 220/331 |
| 3,236,408 | 2/1966 | McFadden et al. | 220/337 |
| 4,437,529 | 3/1984 | Fralish | 220/340 X |

*Primary Examiner*—Stephen Cronin
*Attorney, Agent, or Firm*—Foley & Lardner

[57] ABSTRACT

A covered food serving pan is provided having a food pan from which a flange with tab retainers extends, and a cover with tabs extending from an edge. These tabs engage tab retainers on a flange of the food pan and allow the cover to rotate with respect to the food pan. A method is provided for attaching a cover to a food serving pan by sliding the tabs toward the tabs retainers and engaging them with the tab retainers, rotating the cover about the tab retainers along a first axis of rotation, translating the cover in a direction parallel to the axis of rotation, and again rotating the cover about the axis of rotation until the open end of the pan is covered.

14 Claims, 7 Drawing Sheets

FOOD SERVING PAN WITH REMOVABLE COVER

FIELD OF THE INVENTION

This invention is generally directed to a closure for a food container. More particularly, it is addressed to a removable cover for a steam table pan. More particularly, the invention is directed to a rotatable and removable cover for a food serving pan having an integral handle for lifting the pan.

BACKGROUND OF THE INVENTION

Large food serving pans for containing multiple portions of food and allowing it to be served one portion at a time have been used for many years in commercial food service establishments. These pans are used in food servers such as steam tables, chill tables, salad bars or the like, as well as used as large chafing dishes in chafers. They may be used for storage of food or as transfer pans, to carry large portions of food to and from a serving area, as well. They are typically shallow rectangular stainless steel pans with an open top. A flange usually extends around the circumference of the pan to provide a steam seal around a steam table and often a convenient lifting point. When used in a steam table, salad bar or the like, the receptacle and flange are typically dimensioned so that the receptacle is received into a rectangular opening in table or bar and is supported by its flange resting upon the edges of the rectangular opening.

Covers may be provided for these pans to keep the food hot or cold, to prevent food drying, as well as to reduce contamination by servers, insects, or other sources. The most common covers are substantially flat metal sheets having a single central handle. These covers rest on top of the food service pans, and allow the pans to be stacked and carried. They are not easily manipulated by food servers due to the close proximity of each pan to its neighbor, the server's need to hold the plate and the server's need to scoop the food from the pan. Complicating the problem is the risk of contamination if removable covers are removed and placed on an unclean surface. Once placed on an unclean surface and replaced on the food serving pans, they may contaminate the remaining food.

One solution has been to provide each pan with a two-piece cover, a first rear portion is slidably engaged with a standard pan, to which a second rotatable cover portion is engaged. One problem with this design is that the first, rear portion partially covers the open end of the pan, even when the cover is open. This limits access to the food in the pan. Another problem is that the cover is not firmly attached to the pan, and can slide off when it is carried to and from the steam table.

Food serving pans are difficult to remove from chill or steam tables, salad bars and the like. Due to the light gauge steel of which they are made, and the requirement that their flanges seal against the table or bar, the edges of these pans closely fit the table or bar itself and are difficult to grasp and lift along their flanges.

There is a need, therefore, for an improved means for lifting a food serving pan. In particular, there is a need for a lifting apparatus that is easier to grasp, and does not require a utensil. In addition, there is a need for an improved pan and cover that are easier to operate and connected more securely than the traditional detached or two-piece steam table pan covers.

SUMMARY OF THE PRESENT INVENTION

The present invention features a food serving pan cover, and a food serving pan adapted to receive that cover, that are intended to respond to these needs.

A covered food serving pan is provided including a pan portion for receiving food with a pierced flange having a first tab retainer, a cover portion having first and second edges, adapted to substantially cover an open end of the food serving pan, and a first tab disposed along the first edge that is adapted to engage the tab retainer. The tab may have an upward bend to be received by the tab retainer and a cover retainer extending from an end of the tab to support the cover in an upright and open position. The pan may also have a downward bend disposed between the upward bend and the rest of the cover. The tab retainer may extend above the uppermost surface of the flange. The flange may have lateral opposing edges adjacent to the tab retainer that are depressed below the uppermost surface of the flange. The tab retainer may be in the form of an open or closed ended "H" shaped slit. The tab retainer may be between 0.6 and 1.3 inches in length, and the tab may be up to 1/16 of an inch shorter than the tab retainer. A second tab and tab retainer may be provided. The first and second tab retainers may be separated by a gap of between 0.6 and 0.95 inches. A handle or utensil receving relief may be disposed along the second edge of the cover.

A method for attaching a cover to a food serving pan is provided including the steps of slidingly engaging a tab on the cover with a tab retainer on the pan in a first direction substantially parallel to the open end of the pan, rotating the cover about the tab retainer in a direction that defines a first axis of rotation, translating the cover in a direction substantially parallel to the first axis of rotation, and rotating the cover about the axis of rotation until the cover closes the open end of the pan.

Other principal features and advantages of the invention will become apparent to those skilled in the art upon review of the following drawings, the detailed description and the appended claims.

Figure 1:
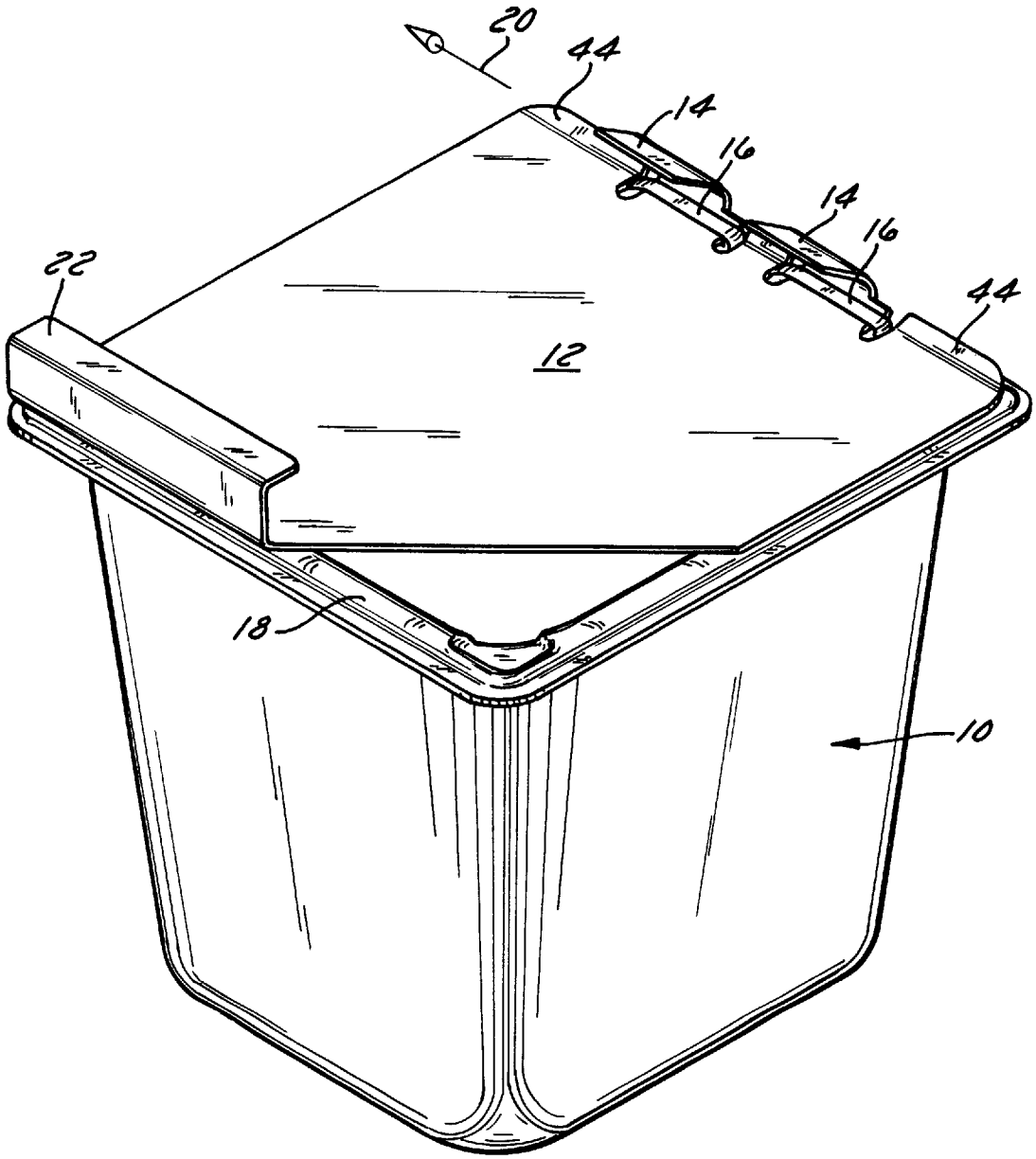
FIG. 1 is a perspective view of a first embodiment of the invention.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Turning now to the drawings and referring to FIG. 1, a food serving pan 10 with rotatably connected cover 12 is disclosed. Tabs 14 extend from cover 12 and engage tab retainers 16 extending from flange 18 of food serving pan 10. Tabs 14 are bent thereby allowing cover 12 to rotate about axis 20. Handle 22 extends from cover 12 and provides a manual gripping point for lifting pan 10.

Figure 2:
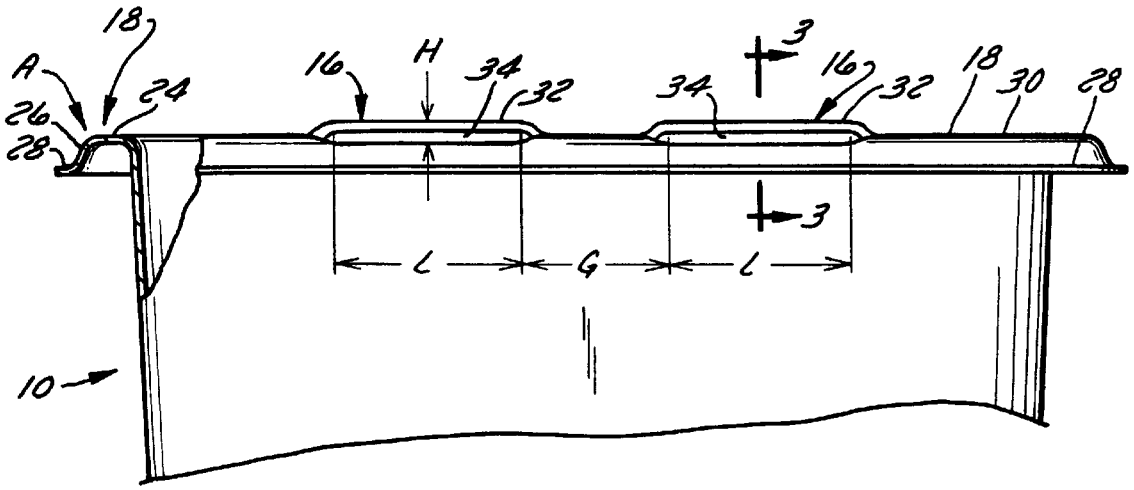
FIG. 2 is a partial cross-sectional view of the pan of FIG. 1.

FIG. 2 is a partial cross-sectional illustration of the FIG. 1 embodiment, showing flange 18 and tab retainers 16 in greater detail. Pan 10 is preferably made of metal, most preferably stainless steel. It has a thickness of between 0.025 and 0.065 inches, as shown in cross-section A. In this embodiment, flange 18 is beaded, having a convex upward portion 24 merging into a concave lower portion 26, which merges into an outer edge portion 28 that is substantially parallel to a plane defined by the uppermost surface 30 of flange 18. Pan 10 has two tab retainers 16 extending upwardly from uppermost surface 30 of flange 18. Tab retainers 16 are adapted to receive and engage tab retainers 14 of cover 12 (not shown). Length L of tab retainers 16 is preferably between 0.6 and 1.4 inches, more preferably between 0.8 and 1.2 inches and most preferably about 0.9 to 1.1 inches, to provide maximum support for pan 10. To provide sufficient clearance for cover 12 (shown in FIG. 1) yet hold cover 12 firmly, the uppermost surface 32 of tab retainers 16 extends preferably between 0.06 and 0.12 inches, most preferably between 0.075 and 0.095, above uppermost surface 30 of flange 18. Gap G is provided between each of tab retainers 16 to provide rotational stability for cover 12 about pan 10, and measures preferably between 0.6 and 0.95 inches. More preferably, it measures between 0.7 and 0.85 inches. Tab retainers 16 define slots 34 which engage tabs 14 of cover 12. For superior retention of cover 12, slots 34 have a height H of between 0.045 and 0.110 inches, and more preferably between 0.065 and 0.085 inches.

Figure 3:
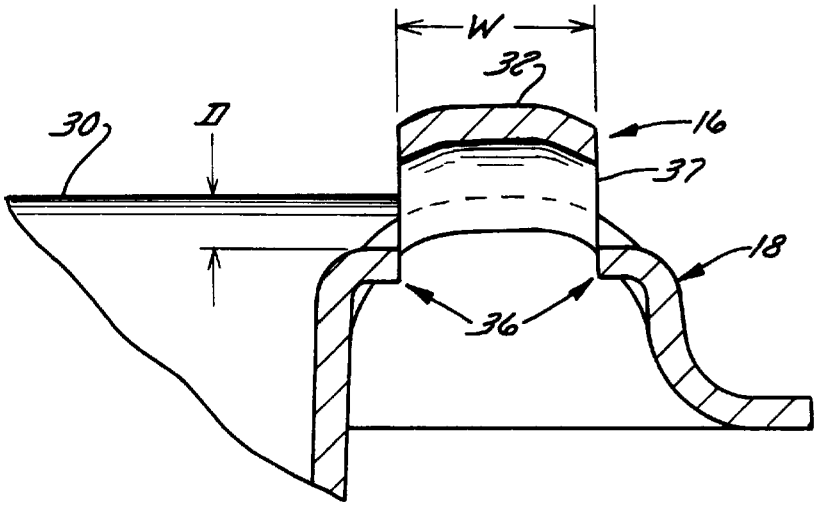
FIG. 3 is a partial cross-sectional view of the bead of the FIG. 2 pan.

FIG. 3 is a cross sectional view of flange 18 taken at Section 3—3 in FIG. 2. Tab retainer 16 has a downwardly facing arcuate cross section with a width W of between 0.09 and 0.24 inches. More preferably, tab retainer 16 has a width of between 0.12 and 0.21 inches. Most preferably, it has a width of between 0.17 and 0.20 inches. Tab retainer 16 is formed after flange 18 is formed, by piercing flange 18 in an upward direction, while simultaneously deforming lower edges 36 of slot 34 downwardly in a die set. In this manner, the uppermost surfaces of lower edges 36 extend below top surface 30 of flange 18 by between 0.02 and 0.08 inches, more preferably between 0.03 and 0.06 inches, and most preferably about 0.045 inches. By forming lower edges 36 below uppermost surface 30, cover 12 closely seals with surface 30, yet is adapted to rotate easily about axis 20 (FIG. 1). Outer edge 37 of tab retainer 16 is adapted to support the cover and will be discussed below.

Figure 4:
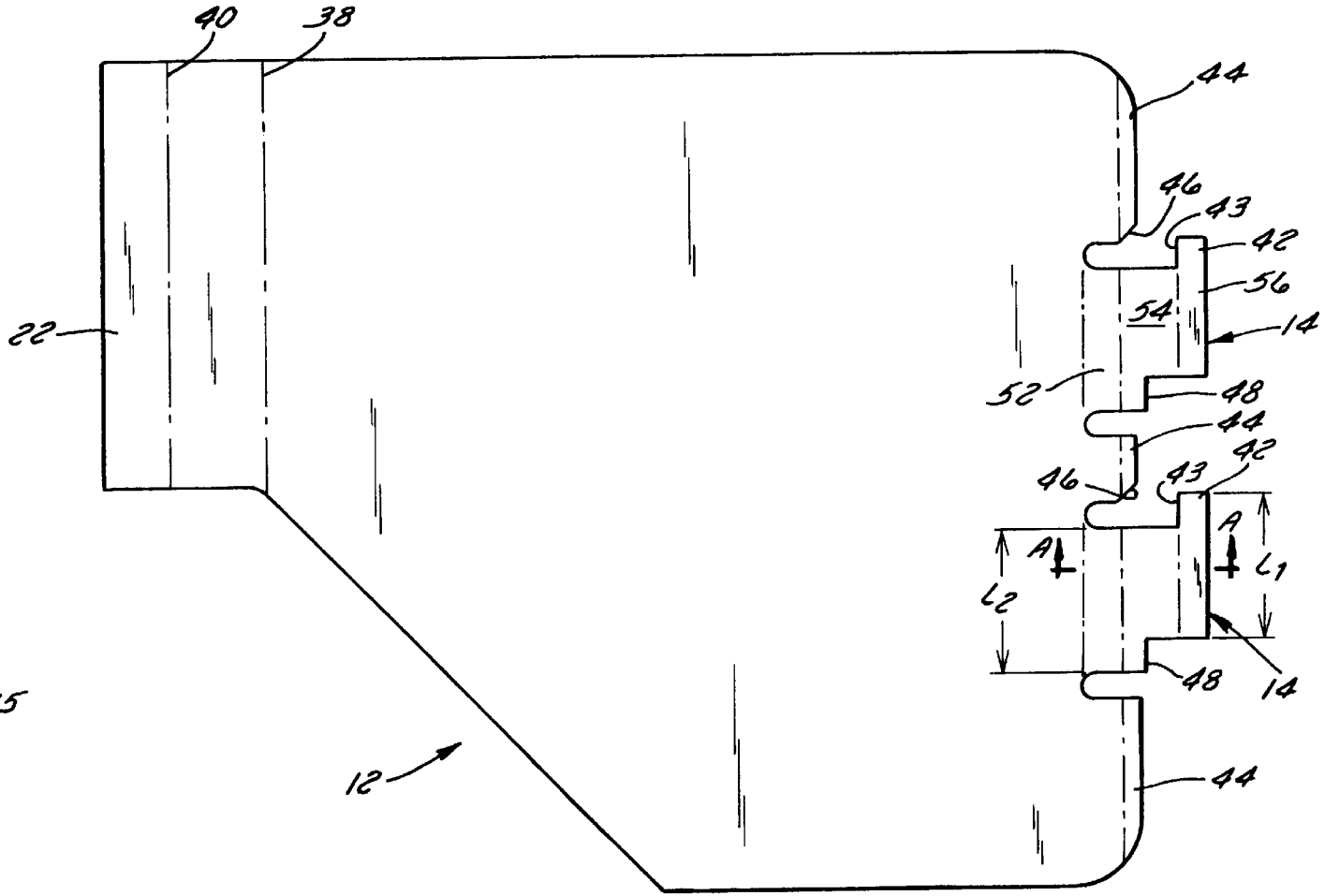
FIG. 4 is a top view of the cover of FIG. 1 before it is bent.

FIG. 4 illustrates cover 12 as stamped and before being bent to form handle 22 and tabs 14. In this embodiment, cover 12 is formed of a single sheet of cover stock, preferably metal, and most preferably stainless steel. Handle 22 (shown in FIG. 1) is formed by bending cover 12 at bending lines 38 and 40. Each of tabs 14 include cover retainers 42, in the form of lateral extensions of tabs 14. Edges 43 of cover retainers 42 are adapted to engage outer edges 37 of tab retainers 16 (FIG. 3), thereby supporting cover 12 in an upright and open position. From a closed position in which it is horizontal and covers pan 10, cover 12 may preferably be opened by rotating it between 95 and 135 degrees about tab retainers 16 before edges 43 contact tab retainers 16 and support cover 12 in an upright position. More preferably the angle is between 100 and 115 degrees. Most preferably, the angle is between 103 and 108 degrees. When the cover retainers are oriented to support the cover at this angle, the cover may be easily placed in an upright position, with little risk of it falling forward and unexpectedly closing while food is being served, but at the same time it will not overbalance an empty pan causing an empty pan to tip over. This angle is illustrated as "ø" in FIG. 9C, discussed below. Cover extensions 44, extend outwardly from cover 12 and, as will be shown below, cover pan 10 along the flange of pan 10 in which tab retainers 16 are formed, thereby preventing foreign matter from entering pan 10 along its slotted edge when cover 12 is installed. Cover extensions 44 are relieved, shown by diagonal edges 46, to allow cover 12 to be more easily installed and removed from pan 10. The length $L_1$ of tabs 14 with cover retainers 42 are preferably up to 1/16 of an inch less than the length L (FIG. 2) of tab retainers 16. A greater difference in length may provide excessive and unacceptable play between the cover and the pan. Similarly, length L of tabs 14 is also up to 1/16 of an inch less than the length L (FIG. 2) of tab retainers 16.

FIGS. 5A–D illustrate several positions of tab 14 with respect to tab retainer 16 that illustrate the interaction between tab 14 and tab retainer 16 as the cover is mounted on pan 10. For purposes of illustration, tab 14 is shown in these figures in a flattened state. This allows the sliding motion of tab 14 with respect to tab retainer 16 to be illustrated in a two dimensional plane. In practice, tabs 14 are bent, as shown in FIGS. 1 and 7–9 and thus are slidingly and rotatingly engaged with tab retainers 16 on pan 10. A view showing the rotational interaction is described below in conjunction with FIGS. 9A–E.

Figure 6:
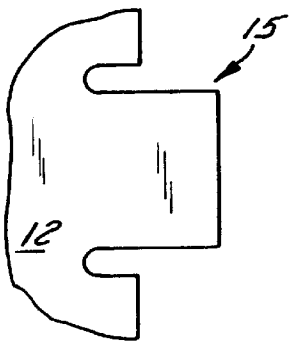
FIG. 6 illustrates an alternative tab for the cover of FIGS. 1, 4 and 5.
Figure 5D:
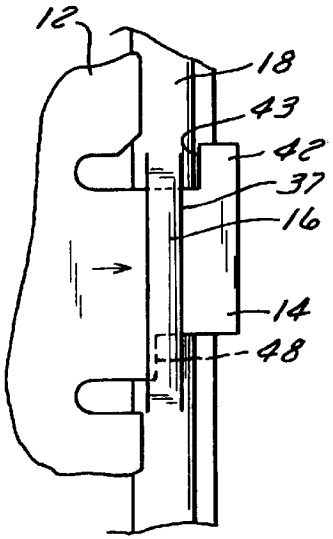
FIGS. 5A–D illustrate the successive steps of engagement of the FIG. 4 cover with the pan of FIGS. 1–3.
Figure 5C:
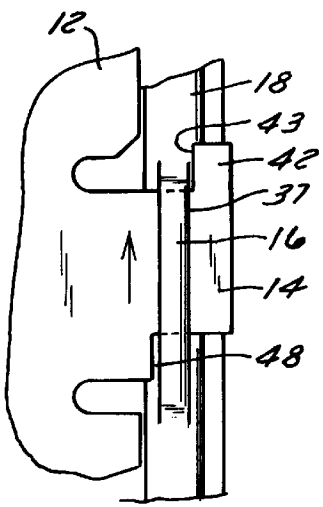
Figure 5B:
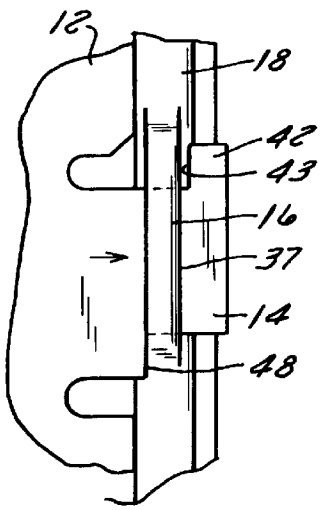
Figure 5A:
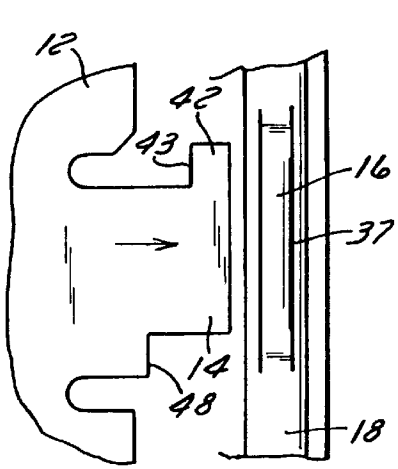

In FIG. 5A, tab 14 is shown in its initial position, as cover 12 and pan 10 are engaged. As tab 14 is moved in the direction of the arrow on cover 12, i.e. parallel to the longitudinal extent of tab 14, tab 14 will slide between tab retainer 16 and flange 18. In FIG. 5B, tab 14 has been inserted until edge 48 of tab 14 abuts tab retainer 16. At the point edge 48 abuts tab 16, the distal end of cover retainer 42 has cleared the edge of tab 16 permitting tab 14 to move in a direction perpendicular to the longitudinal extent of tab 14 as indicated by the arrow on cover 12. In FIG. 5C, tab 14 has moved perpendicular to the longitudinal extent of tab 14 until edge 50 of tab 14 abuts tab retainer 16. At this point, edge 48 no longer abuts tab retainer 16, and tab 14 may be further inserted into tab retainer 16 in a direction parallel to the longitudinal extent of tab 14. It is clear that when tab 14 is inserted completely into tab retainer 16, any sliding of tab 14 simply in a direction parallel to its longitudinal extent will not cause tab 14 to be removed from tab retainer 16, and thus cover 12 from pan 10. While FIGS. 5A–D illustrate the operation of tab 14 with cover retainer 42, the retainer is not required to engage tab 14 with tab retainer 16. In an alternative embodiment, the tab may have no retainer, such as tab 15, illustrated in FIG. 6.

Figure 7:
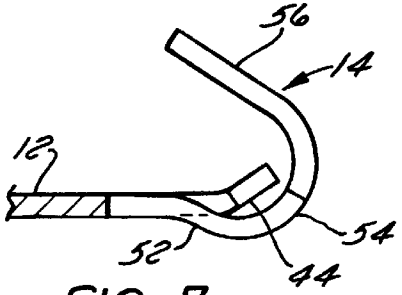
FIG. 7 is a cross-sectional view of a tab of the cover of FIG. 4, as bent.

FIG. 7 is a cross-sectional view of cover 12 at Section A—A in FIG. 4 illustrating the appearance of tab 14 when bent. Tab 14 has a first downward bend 52, preferably with an inside radius of between 0.062 and 0.187 inches. This bend describes an arc of between 15 and 60 degrees, more preferably between 20 and 40 degrees. Travelling outwardly along tab 14, after downward bend 52 is upward bend 54, with an inside radius of between 0.062 and 0.250 inches, and more preferably between 0.08 and 0.15 inches. This bend describes an arc of between 120 and 210 degrees, more preferably between 160 and 190 degrees. Following upward bend 54 is flat portion 56. By providing a downward bend 52 followed by an upward bend 54, a portion of tab 14 is provided that extends below the planar surface of the rest of cover 12, and will optimally engage with the inner and outer edges of tab retainer 16 and outer and inner edges 37 of flange 18 (FIG. 3). This arrangement allows cover 12 to be rotated about axis 20 (FIG. 1) without binding and bending either tabs 14 or tab retainer 16.

Figure 8:
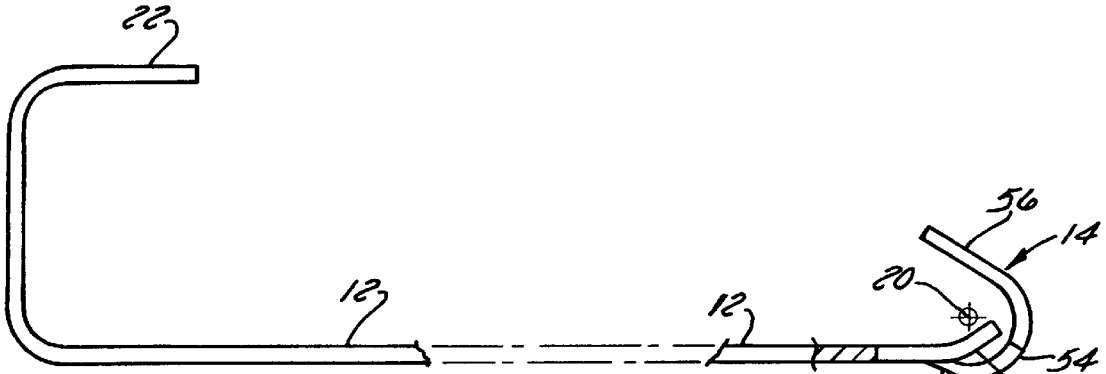
FIG. 8 is a cross-sectional view of the cover of FIG. 4 as bent.

FIG. 8 is an edge view of cover 12 showing tabs 14 and cover extensions 44. These extensions are provided to extend to and partially cover flange 18 (not shown) thereby preventing foreign matter from falling into pan 10. They extend past the axis of rotation 20 of cover 12, and are upwardly bent to prevent their interference with flange 18 when cover 12 is installed or removed, and opened or closed.

Figure 9E:
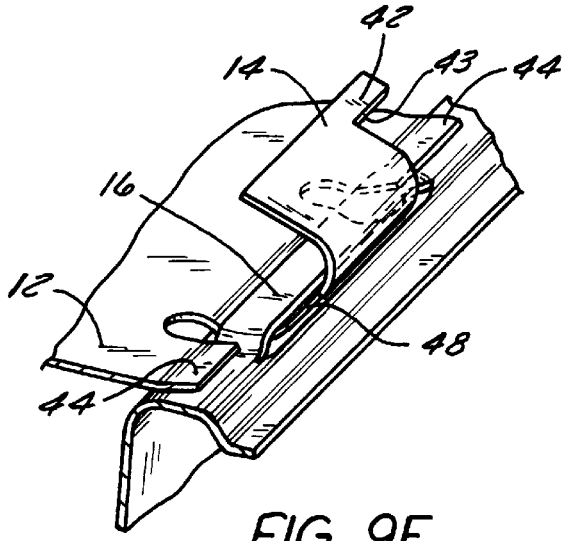
FIGS. 9A–E are perspective views of a tab of the cover of FIG. 1 in various stages of engagement.
Figure 9A:
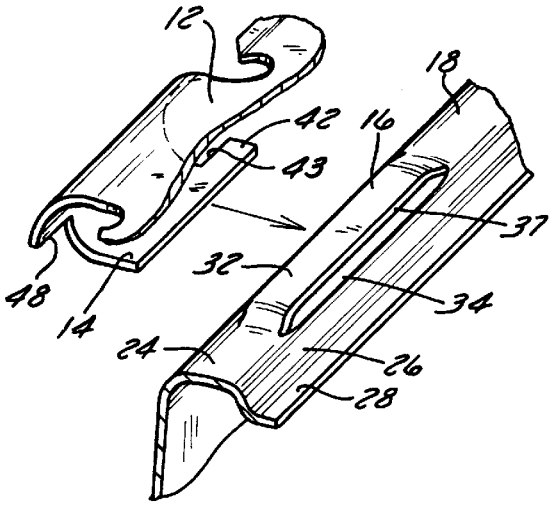
Figure 9B:
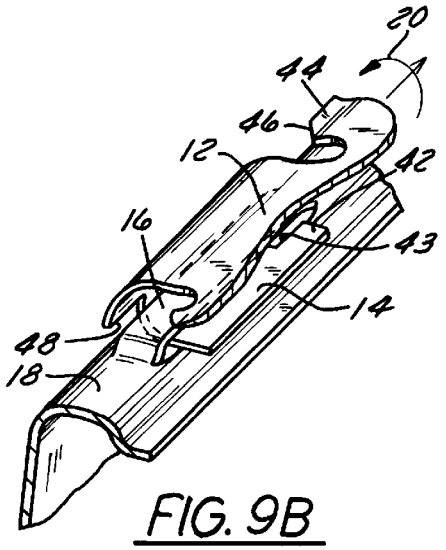
Figure 9C:
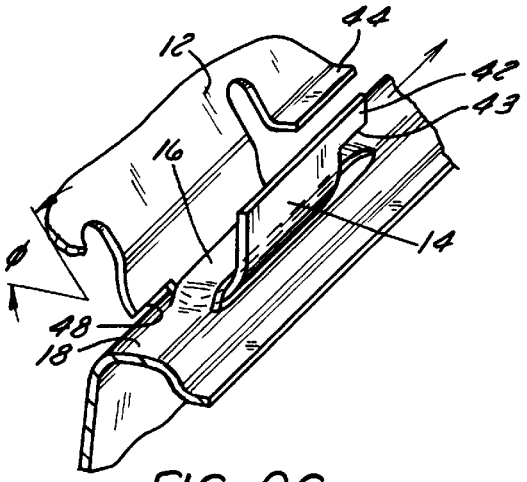
Figure 9D:
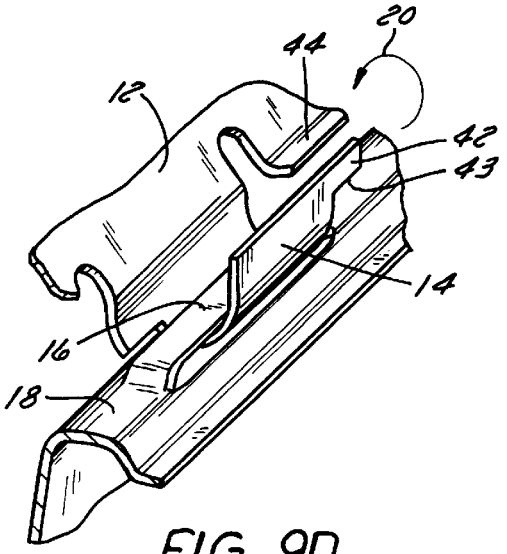

FIGS. 9A–E illustrate, in perspective, pan 10, cover 12 and the manner in which they are engaged. In FIG. 9A, cover 12 is disengaged from pan 10. To engage tab 14 with tab retainer 16, tab 14 is advanced toward pan 10 laterally in the direction of the arrow. In FIG. 9B, tab 14 has been advanced until it begins to bind with tab retainer 16. To engage tab 14 further with tab retainer 16, tab 14 must be simultaneously inserted into tab retainer 16 and rotated about axis 20. FIG. 9C illustrates the next stage of engagement, after tab 14 has been further engaged with tab retainer 16. At this point, edge 43 of cover retainer 42 has just cleared tab retainer 16, and edge 48 has not yet engaged tab retainer 16. To further engage tab 14 to tab retainer 16, tab 14 must be moved laterally with respect to tab retainer 16. This lateral motion is indicated by the directional arrow, and the change in relative positions of cover 12 and pan 10 is illustrated in FIG. 9D. In FIG. 9D, the cover is in a substantially upright position. It is maintained in this position by cover retainer 42 resting against tab retainer 16. The cover illustrated in FIG. 9D may be closed by further rotation in the direction of the arrow shown in FIG. 9D. The closed position is illustrated in FIG. 9E.

Figure 10:
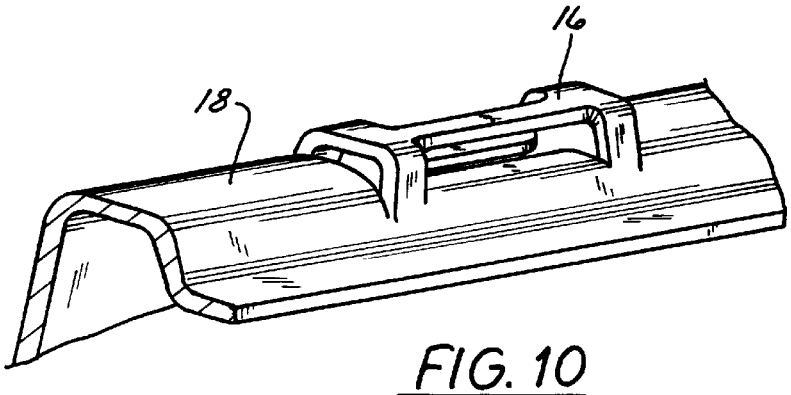
FIGS. 10 and 11 are perspective views of alternative tab retainers.
Figure 11:
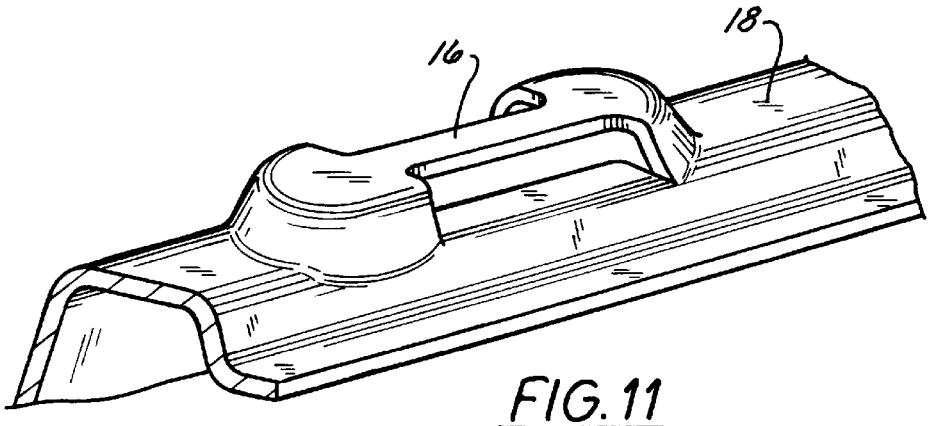

FIGS. 10 and 11 illustrate alternative embodiments of tab retainer 16 for retaining tab 14. FIG. 10 illustrates an open "H" style tab retainer 16 in the flange 18 of a food serving pan. FIG. 11 illustrates a closed-end "H" style tab retainer 16 in the flange 18 of a food serving pan.

Figure 12:
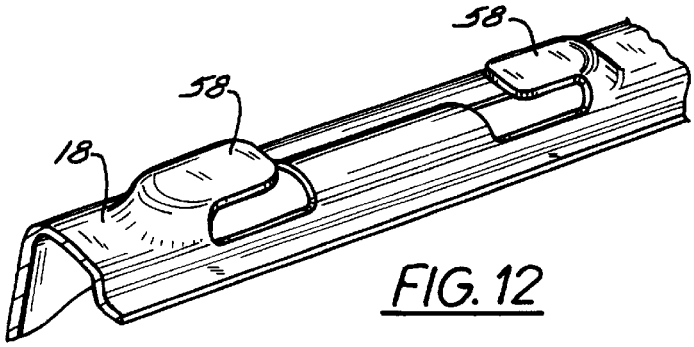
FIG. 12 illustrates a perspective view of an alternative tab retainer.

Each of the tab retainers illustrated above is in the form of an elongate member attached at either end to flange 18 of the food serving pan. In an alternative embodiment, two tab retainers 58 may be provided in place of tab retainer 16, as illustrated in FIG. 12. In this embodiment, tab retainers 58 extend around opposing edges of a cover tab (not shown). The spacing of these pairs of tabs is the same as that shown in FIGS. 2 and 3, and the method of engagement the same as that described above.

Figure 13:
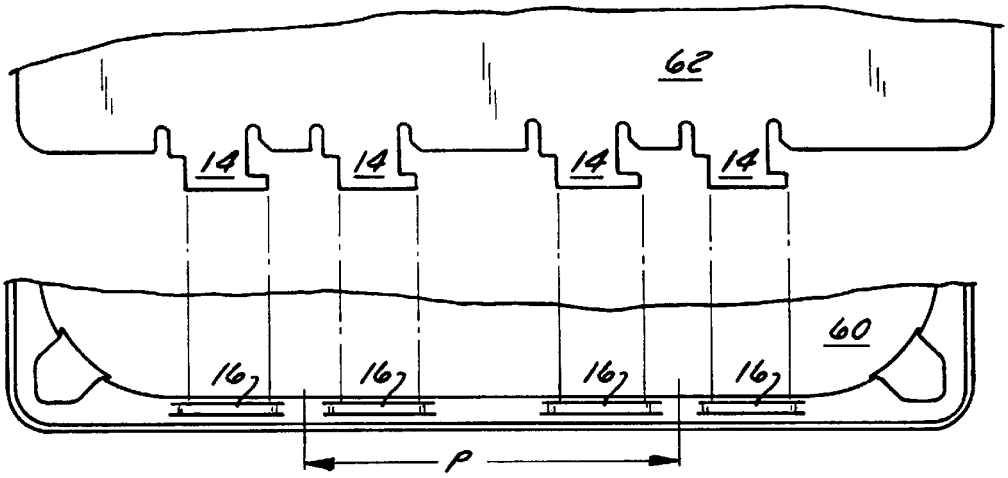
FIG. 13 illustrates a cover and pan arrangement having two pairs of tabs.
Figure 14:
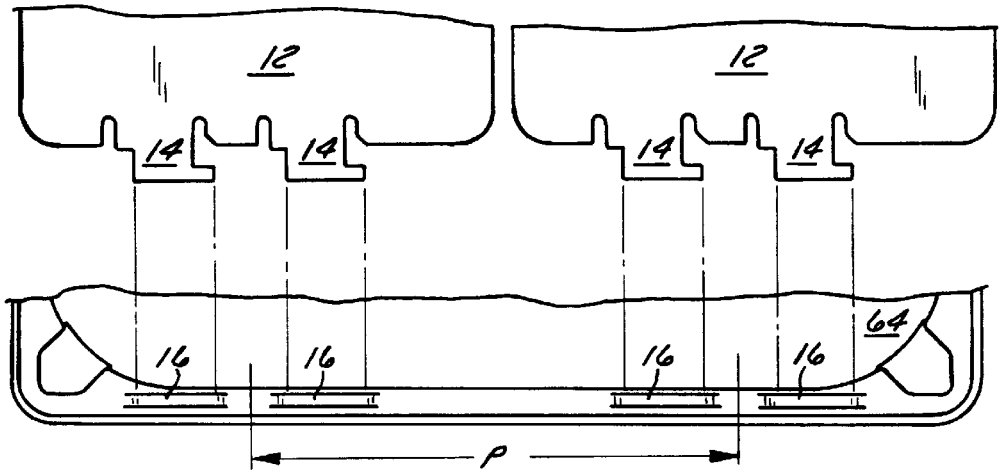
FIG. 14 illustrates a cover and pan arrangement wherein a plurality of covers are provided for a single pan.

The food serving pans and respective covers 12 shown above all have two tabs 14 that engage respective tab retainers 16 on pans 10. For larger pans, however, it is beneficial to provide additional tabs and tab retainers, such as those illustrated in FIGS. 13 and 14 in which tabs 14 are shown in a flattened condition for ease of recognition. FIG. 13 shows the back of a full-width food serving pan 60 and its respective cover 62. Pan 60 is approximately 12.75 inches wide overall. For pan 60 and cover 62, four tabs 14 with corresponding tab retainers 16 are preferred. Tabs 14 and tab retainers 16 may be constructed and used in the same manner as the previously discussed embodiments. As shown in FIGS. 13 and 14, tabs 14 and tab retainers 16 are oriented as adjacent pairs of tabs. Each adjacent pair preferably has the same internal spacing (e.g. the "L" and "G" dimensions) as that described above. Two different pair-to-pair spacings are provided in FIGS. 13 and 14. As seen in FIG. 13, a pair-to-pair spacing "P" measured between the centerlines of the respective pairs is preferably between 4 and 5.5 inches. More preferably it is between 4.5 and 5.2 inches. Most preferably it is between 4.7 and 5.0 inches. These dimensions provide superior structural strength, while still allowing for easy engagement of the cover with the pan.

Regarding pan 64 and corresponding covers 12 of FIG. 14, a different cover spacing may be provided when a pan 64 is adapted to engage a plurality of covers 12. In this figure, the spacing "P" between centerlines of adjacent pairs of tab retainers is between 5.5 and 7.1 inches. More preferably it is between 6.0 and 6.7 inches. Most preferably it is between 6.2 and 6.5 inches. The covers in this pan share a common axis of rotation about tab retainers 16. Covers 12 shown in FIG. 14 are also adapted to be engaged with pan 10 as shown above. Thus covers may be advantageously engaged with a plurality of pans having different overall dimensions. Pan 64 of FIG. 14 may also have a single cover with four tabs (such as that shown in FIG. 13) engaged to it, albeit a cover having a different centerline spacing between adjacent pairs of tabs 14. Thus, a single pan may engage a plurality of covers, including a single cover covering substantially the whole pan, or a plurality of covers, each covering a portion of the pan. It is advantageous to provide covers that are adapted to be engaged with different pans having different overall dimensions, and to provide pans that are adapted to be engaged with different covers having different overall dimensions since fewer unique cover and pan configurations need to be provided.

Thus, it should be apparent that there has been provided in accordance with the present invention a food serving pan with removable cover that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A covered food serving pan, comprising:

a pan portion for receiving food and having a pierced flange, wherein the pierced flange defines a tab retainer that extends above the uppermost surface of the flange wherein the flange has lateral opposing edges adjacent to the tab retainer that are depressed below the uppermost surface of the flange;

a cover portion having first and second sides, adapted to substantially cover an opening of the food serving pan, and a first tab disposed along the first edge that is adapted to engage the tab retainer.

2. The covered food serving pan of claim 1, wherein the tab retainer is in the form of an open ended "HI" shaped slit.

3. The covered food serving pan of claim 1, wherein the tab retainer is in the form of a closed end "H" shaped slit.

4. The covered food serving pan of claim 1, wherein the cover further includes a handle disposed along the second side of the cover.

5. The covered food serving pan of claim 4, wherein said handle is adapted to lift said cover portion and said pan portion.

6. The covered food serving pan of claim 1, wherein the tab has an upward bend that is received by the tab retainer.

7. The covered food serving pan of claim 6, wherein the tab has a cover retainer extending from one end of the tab and adapted to support the cover in a substantially upright and open position.

8. The covered food serving pan of claim 7, wherein the tab has a further downward bend disposed between the upward bend and the rest of the cover.

9. The covered food serving pan of claim 1, wherein the tab retainer is between 0.6 and 1.3 inches in length.

10. The covered food serving pan of claim 9, wherein the tab is up to 1/16 of an inch shorter than the tab retainer.

11. The covered food serving pan of claim 10, further comprising a second tab and a second tab retainer adapted to engage the second tab.

12. The covered food serving pan of claim 11, wherein the first and second tab retainers are separated by a gap of between 0.6 and 0.95 inches.

13. The covered food serving pan of claim 12, wherein the cover defines a utensil receiving relief along the second edge of the cover.

14. A method for attaching a cover to a food serving pan having an opening including the steps of:

slidingly engaging a tab on the cover with a tab retainer on the pan in a first direction substantially parallel to the opening of the pan;

rotating the cover about the tab retainer in a direction that defines a first axis of rotation;

translating the cover in a direction substantially parallel to the first axis of rotation; and rotating the cover about the axis of rotation until the cover closes the opening of the pan.

* * * * *